US008448563B2

(12) United States Patent
Wenker et al.

(10) Patent No.: US 8,448,563 B2
(45) Date of Patent: May 28, 2013

(54) FLUID-POWERED ACTUATOR HAVING AN INTERNAL POSITION SENSOR AND A SENSOR MODULE THEREFOR

(75) Inventors: René Wenker, Beaconsfield (CA); Daniel Gagné, Montréal (CA)

(73) Assignee: Cowan Dynamics Inc., Montréal (CA)

( * ) Notice: Subject to any disclaimer, the term of this patent is extended or adjusted under 35 U.S.C. 154(b) by 896 days.

(21) Appl. No.: 12/201,137

(22) Filed: Aug. 29, 2008

(65) Prior Publication Data

US 2010/0050863 A1 Mar. 4, 2010

(51) Int. Cl.
*F01B 25/04* (2006.01)

(52) U.S. Cl.
USPC ..... 92/5 R

(58) Field of Classification Search
USPC ..... 62/5 R
See application file for complete search history.

(56) References Cited

U.S. PATENT DOCUMENTS

| | | | | |
|---|---|---|---|---|
| 3,438,306 | A | 4/1969 | Kazmarek | |
| 4,386,552 | A | 6/1983 | Foxwell | |
| 4,543,649 | A | 9/1985 | Head et al. | |
| 4,552,055 | A | 11/1985 | Foxwell | |
| 4,632,018 | A | 12/1986 | Lymburner | |
| 4,794,841 | A | 1/1989 | Kemmler et al. | |
| 5,617,034 | A | 4/1997 | Lark et al. | |
| 5,955,881 | A * | 9/1999 | White et al. | 324/207.2 |
| 5,977,778 | A | 11/1999 | Chan et al. | |
| 6,005,395 | A | 12/1999 | Chan et al. | |
| 6,142,059 | A | 11/2000 | Chan et al. | |
| 6,509,733 | B2 | 1/2003 | Blubaugh et al. | |
| 6,694,861 | B2 | 2/2004 | Glasson | |
| 6,702,600 | B2 | 3/2004 | Glasson | |
| 7,023,199 | B2 | 4/2006 | Blubaugh et al. | |
| 7,059,238 | B2 | 6/2006 | Albright et al. | |
| 7,093,361 | B2 | 8/2006 | Richard | |
| 7,290,476 | B1 | 11/2007 | Glasson | |
| 7,520,208 | B2 * | 4/2009 | Beuth et al. | 92/5 R |
| 2001/0018861 | A1 | 9/2001 | Glasson | |
| 2005/0081710 | A1 | 4/2005 | Albright et al. | |
| 2006/0037467 | A1 | 2/2006 | McCarroll et al. | |

* cited by examiner

*Primary Examiner* — F. Daniel Lopez
(74) *Attorney, Agent, or Firm* — Bereskin & Parr LLP

(57) ABSTRACT

A fluid-powered actuator comprises a cylindrical body having a base proximate one extremity and a head proximate another extremity, a piston-rod assembly and a sensor module made of a removable cover and a position sensor. The piston-rod assembly is slidably mounted inside the cylindrical body. The base is provided with an opening adapted to accommodate the sensor therethrough. In operation, the cover seals the opening. The position sensor is mounted to an internal face of the cover so that the position sensor is operatively located inside the cylindrical body when the cover is in place. The position sensor is operative to measure a position of the piston-rod assembly. A sensor module adapted to sealably close the opening in the base comprises the position sensor mounted to an internal face of a cover structure. In operation, the position sensor is operatively located inside the actuator when the cover structure closes the opening.

12 Claims, 3 Drawing Sheets

FLUID-POWERED ACTUATOR HAVING AN INTERNAL POSITION SENSOR AND A SENSOR MODULE THEREFOR

FIELD OF THE INVENTION

The present invention generally relates to the field of fluid-powered actuators. More specifically, the invention relates to a hydraulic or pneumatic actuator that is equipped with an internal position sensor that may be easily serviced in case of failure.

BACKGROUND OF THE INVENTION

Fluid powered actuators, whether they are hydraulic or pneumatic, are widely used for operating different pieces of equipment. In particular, these actuators may be used to operate valves on stationary machinery such as in complex pipe works in chemical plants.

As these actuators may control mixing valves, it is often necessary to know the exact position of the valve. This is typically achieved by monitoring the position of an actuator rod that is attached to the valve. A well-known solution is to install a position sensor, like a displacement linear transducer, on the outside of an actuator body, with a mobile end of the position sensor connected to the actuator rod so that the position of the valve is tracked.

However, because the actuators are commonly placed in areas that are exposed to harsh environments, the position sensor routinely fails. Moreover, because the actuators may also be installed in tight, difficult to reach areas, the replacement of the failed position sensor is cumbersome. Sometimes, the position sensor is so clogged with contaminants and the actuator so dirty, that it is necessary to completely remove the actuator since another position sensor cannot be installed in those conditions. The absence of the actuator generates equipment downtime, which translates into production, and therefore money, losses.

Different approaches have been suggested to solve this problem, mainly by protecting the position sensors from the environment. U.S. Pat. No. 7,290,476 to Glasson discloses a position sensor, such as an LVDT (linear variable displacement transducer), for a hydraulic cylinder. The position sensor is installed inside the cylinder, either on the cylinder bottom cap or on the cylinder head cap, and connected to the piston. Advantageously, the position sensor is protected from harsh environment. However, in case of failure of the position sensor, the whole actuator needs to be replaced since replacing the position sensor needs opening up the actuator.

Another solution has been proposed in U.S. Pat. No. 7,023,199 to Blubaugh et al. This patent discloses an actuator equipped with a position sensor that is fixed to the exterior of the cylinder bottom cap. The position sensor is of the magneto-restrictive type, which uses a pipe protruding inside the actuator, more precisely inside the center of the piston and rod. This type of sensor requires the use of magnets mounted on a mobile component of the actuator, such as the piston or the piston rod. An electronic module of the position sensor, mounted outside the actuator, is protected from the environment by a cover. A drawback of this design, though, is that the magnets may become contaminated, which then requires the disassembly of the actuator to access the magnets and replace them. This leads to downtime. Moreover, this type of sensor necessitates that the internal mobile components of the actuator, such as the piston and rod, be designed specifically to accommodate the pipe. This increases the price of the actuator. Furthermore, the operational temperature range of magneto-restrictive sensors is limited such that they may not work properly under certain environmental conditions.

There is therefore a need for an improved actuator capable of monitoring the position of its mobile components.

SUMMARY OF THE INVENTION

It is an object of the present invention to provide a fluid-powered actuator that overcomes or mitigates one or more disadvantages of known fluid-powered actuators, or at least provides a useful alternative.

It is an object of the invention to provide a fluid-powered actuator having a position sensor that is protected from the environment.

It is another object of the invention to provide a fluid-powered actuator offering the possibility to replace its position sensor without having to remove the whole actuator from where it is mounted.

In accordance with an embodiment of the present invention, there is provided a fluid-powered actuator comprising a cylindrical body having a base proximate one extremity and a head proximate another extremity, a piston-rod assembly, a removable cover and a position sensor. The piston-rod assembly is slidably mounted inside the cylindrical body. The base is provided with an opening adapted to accommodate the sensor therethrough. In operation, the cover seals the opening. The position sensor is mounted to an internal face of the cover so that the position sensor is operatively located inside the cylindrical body when the cover is in place. The position sensor is operative to measure a position of the piston-rod assembly.

In accordance with another embodiment of the present invention, there is provided a sensor module adapted to sealably close the opening in the base of the fluid-powered actuator. The sensor module comprises a cover structure that is operative to sealably close the opening and a position sensor. Again, the position sensor is mounted to the internal face of the cover structure so that the position sensor is operatively located inside the actuator when the cover structure closes the opening.

Optionally, the sensor module further comprises an analog converter connected to the position sensor ratiometric output for converting a signal from said position sensor to an analog electric signal such as electric voltage or current signal. The converter is mounted on the internal face of the cover structure.

BRIEF DESCRIPTION OF DRAWINGS

These and other features of the present invention will become more apparent from the following description in which reference is made to the appended drawings wherein.

DETAILED DESCRIPTION OF THE INVENTION

The present invention relates to an actuator of the type used with a pneumatic or a hydraulic source of power. The actuator is provided with a position sensor allowing the measurement of the location of its piston-rod assembly with respect to its cylindrical body. Conveniently, the position sensor is mounted on the internal face of a removable cover located in a base of the actuator. Not only is the position sensor protected from the harsh environment where such actuators are sometimes used, but also the position sensor may easily be replaced, without removing the actuator from its location, by simply removing the cover from the base.

Figure 1:
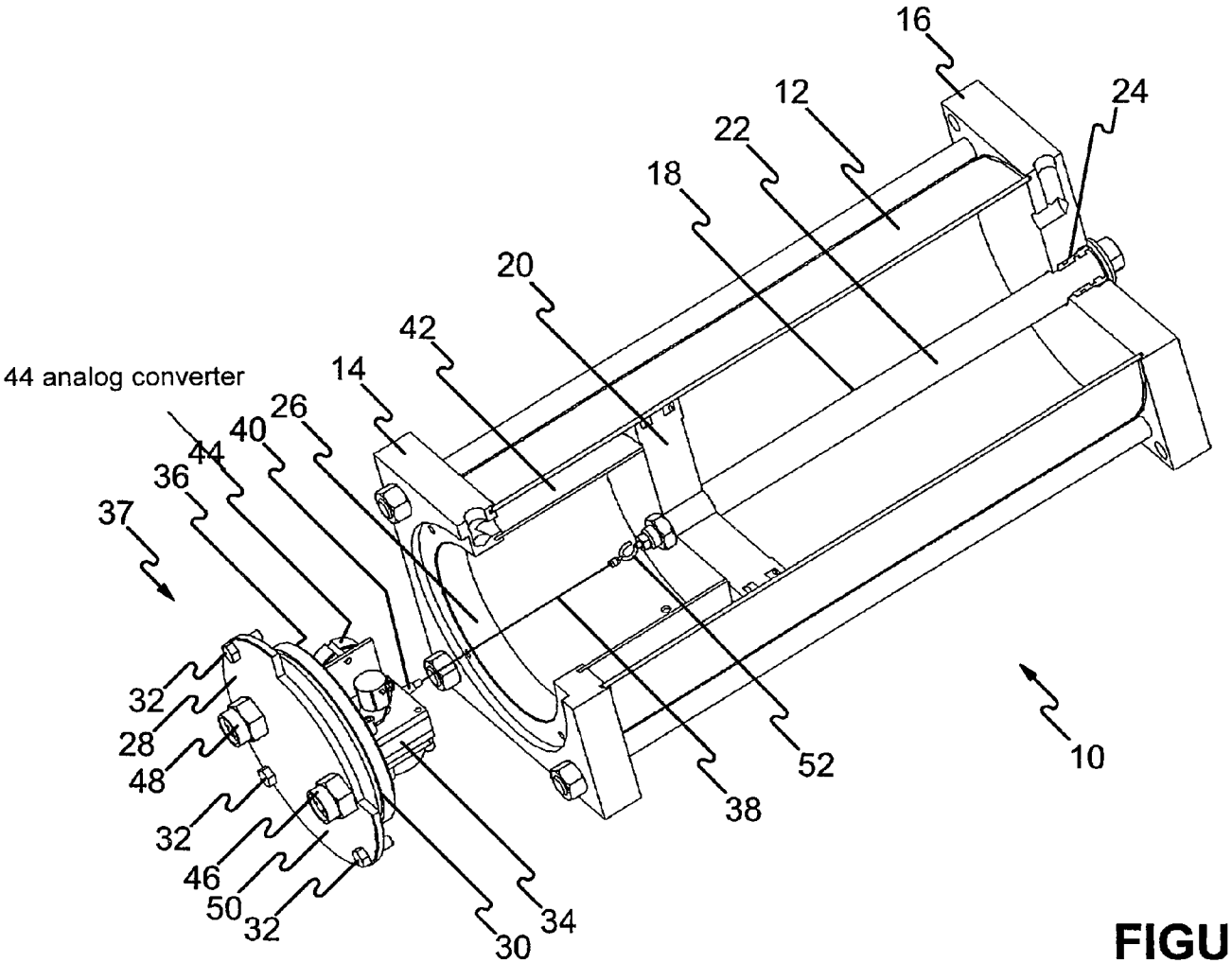
FIG. 1 shows an axonometric, partly cut away view of the actuator of the present invention where the cover and the position sensor are removed from the base.

FIG. 1 shows an actuator 10 of a type that could be suitable for use with a fluid power source, such as compressed air or oil. The actuator 10 comprises a cylindrical body 12 having a base 14 proximate one extremity of the cylindrical body 12 and a head 16 proximate another extremity of the cylindrical body 12. A piston-rod assembly 18, comprising a piston 20 and a rod 22, is slidably mounted inside the cylindrical body 12, the rod 22 protruding from a hole 24 in the head 16. This type of construction of a fluid-powered actuator is conventional and is well known in the art.

Figure 2:
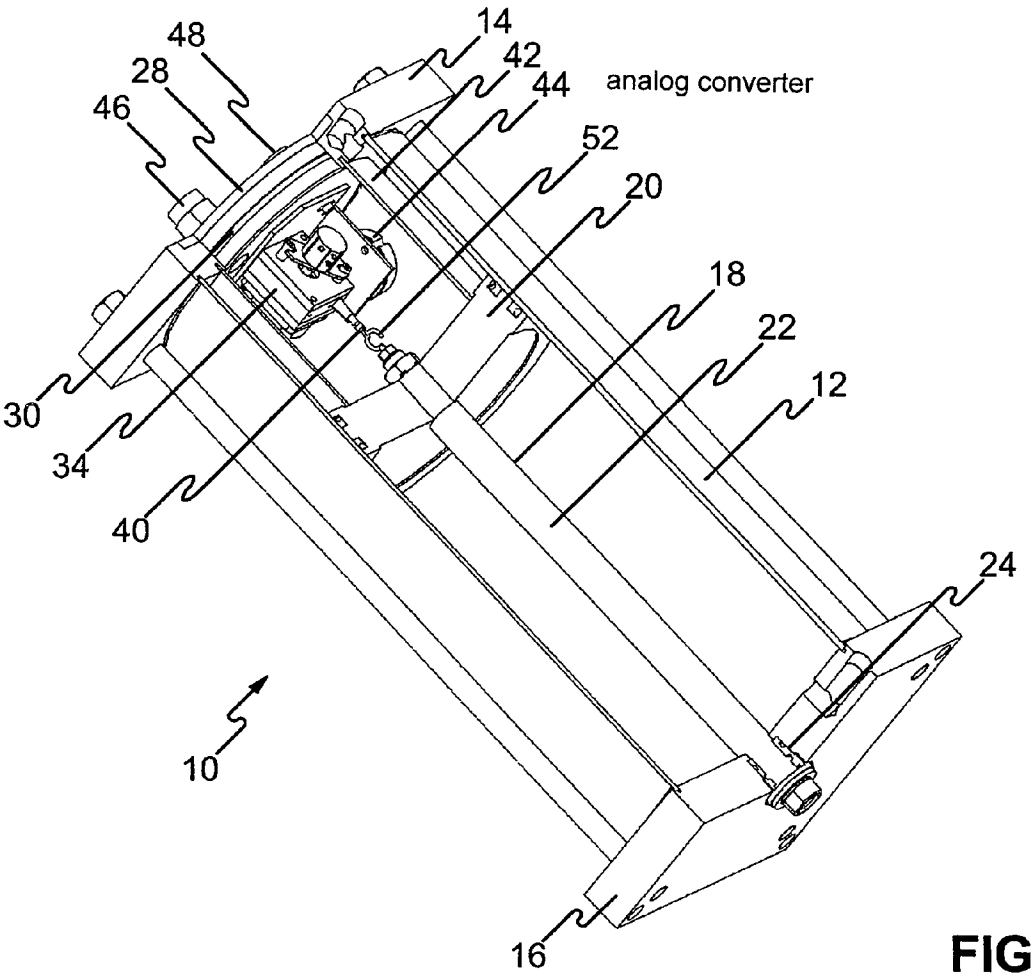
FIG. 2 is an axonometric view, partly cut away view of the actuator of FIG. 1 where the cover and position sensor are operatively installed in place.

In the present invention, however, the base 14 is provided with an opening 26 and a removable cover 28 used to sealably close the opening 26. Indeed, an o-ring 30 (best shown in FIG. 2 and now concurrently referred to) may be used to seal the cover 28 against the base 14. The cover 28 may be attached to the base 14 by different fastening means. However, considering the pressures reached inside the actuator 10, it may be preferable to fix the cover 28 to the base 14 using screws 32. For the same reason, the cover 28 must be sufficiently rigid not to break the seal under pressure.

A position sensor 34 is mounted to an internal face 36 (best shown in FIG. 2) of the cover 28. Hence, when the cover 28 is in place, the position sensor 34 is operatively located inside the cylindrical body 12. The position sensor 34 is operative to measure a relative position of the piston-rod assembly 18. Mostly, the position sensor 34 will measure the relative position of the piston-rod assembly 18 with respect to itself. However, it could measure the relative position with respect to any other part that does not move with respect to the position sensor 34, such as the cylindrical body 12 for example.

Different types of position sensors may be used, such as those using lasers, ultrasounds, or magnetic properties (such as magnetostrictive linear position sensors). These, however, have some drawbacks. They are still rather expensive and some of them are adversely affected by vibrations, to which the actuators are sometimes exposed. Hence, for cost reasons and because it provides adequate performance, it was found preferable to use a draw wire transducer as the position sensor. The accuracy achieved with the draw wire transducer is typically ±0.5% and better, which is sufficient in most applications. Moreover, once their wire is retracted, this type of position sensor is relatively compact, which is an advantage for its replacement when the actuator is installed in a confined area.

As the position sensor 34 is mounted on the internal face 36 of the cover 28, the opening 26 must be sufficiently large to accommodate the position sensor 34 therethrough. Conveniently, the design of the opening 26 and of the cover 28 may be standardized across a product line of actuators. Hence, even if different sizes of actuators are required for different applications, only one sensor module 37, comprising the position sensor 34 mounted on the cover 28, is required. In a simple design, the cover 28 may fit over the opening 26. Alternatively, the cover 28 may fit at least partially within the opening 26.

If a draw wire transducer is used as the position sensor 34, its wire 38 must be attached to the piston-rod assembly 18. It is preferable to center the wire 38 on the piston-rod assembly 18 in case the piston-rod assembly 18 would rotate as it travels in the cylindrical body 12. Similarly, a wire outlet 40 of the position sensor 34 should also be centered in the cylindrical body 12. Hence, even if the piston-rod assembly 18 rotates, the length of the wire 38 remains constant.

The actuator 10 may be provided with a stopper 42 to prevent the piston-rod assembly 18 from retracting too much and crush the position sensor 34. This stopper 42 may take the form of a tube that is concentric with, and inside the cylindrical body 12.

The typical position sensor 34 provides a ratiometric analog output signal and, with the addition of an optional signal converter 44 connected to this position sensor 34, can provide an analog electric signal such as electric voltage or electrical current from the ratiometric analog output signal. The electrical analog signal is then sent to an analog connector 46. However, if the signal converter 44 is not used, the analog connector 46 is directly connected to the position sensor 34. Conveniently, the converter 44 is also mounted on the internal face 36 of the cover 28 while the analog connector 46 is mounted to an external face 50 of the cover 28.

Figure 3:
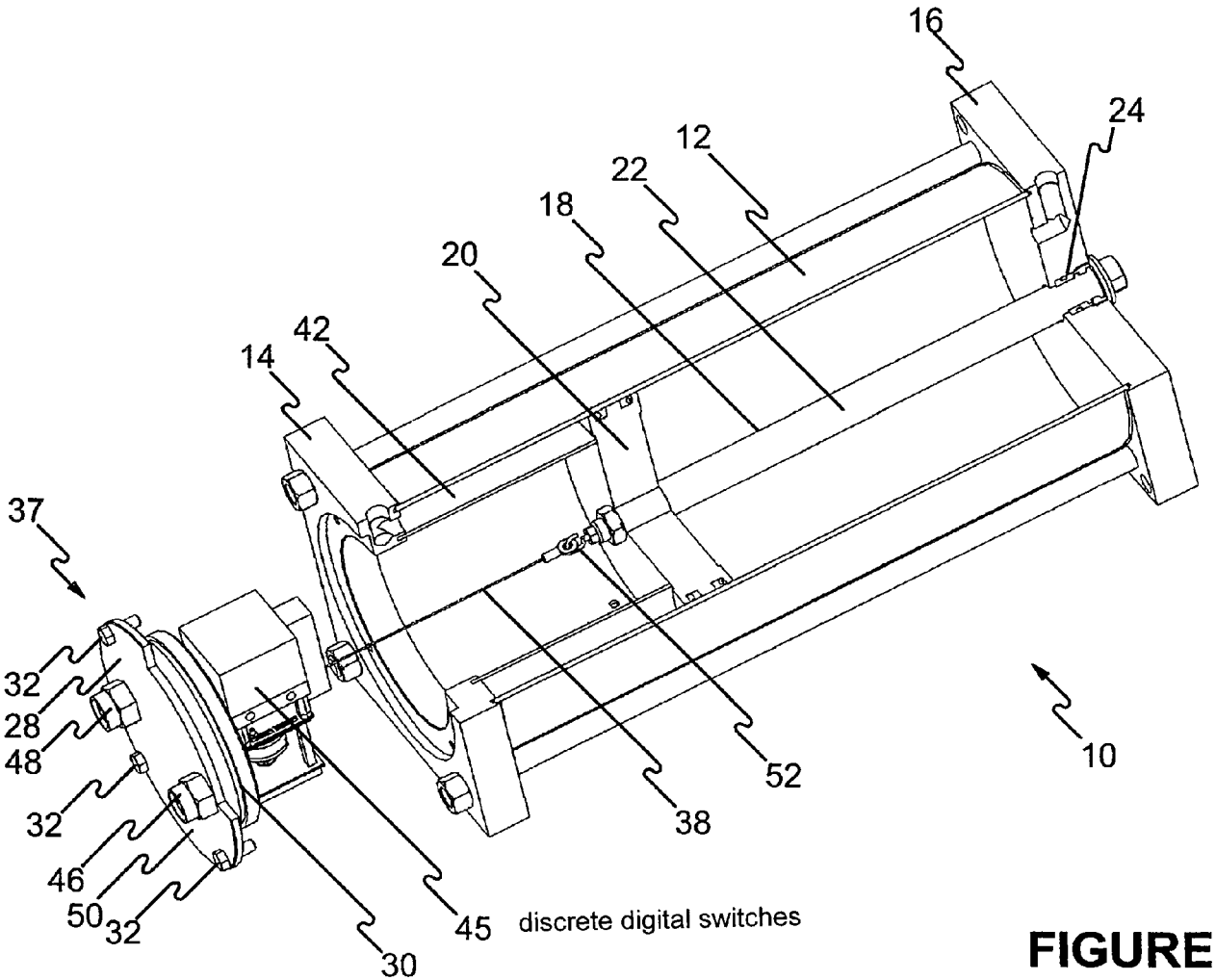
FIG. 3 is an axonometric view, partly cut away view of the actuator of FIG. 1 where the cover and position sensor are operatively installed in place and where digital discrete switches are installed.

In another embodiment of the invention, the position sensor 34 may additionally be equipped with a cam-switch unit with integrated digital discrete switches 45, best shown in FIG. 3 and now concurrently referred to, to provide discrete outputs of the position of the piston-rod assembly 18. This embodiment of the invention thus supplies both a ratiometric analog output signal and a discrete digital output signal. The ratiometric analog output signal can still be converted to an electrical signal with the optional signal converter 44. The analog signal, either ratiometric or electrical, is transmitted to the analog connector 46 and the digital discrete switches 45 are connected to a digital connector 48. The digital discrete switches 45 can be adjusted to activate at different stroke positions of the piston-rod assembly 18. It is common to adjust the digital discrete switches 45 to provide a signal only at both ends of the piston stroke, that is either for a fully retracted or a fully extended piston-rod assembly. Both the analog connector 46 and the digital connector 48 are mounted on the external face 50 of the cover 28.

Conveniently, if ever one of the component of the sensor module 37 fails, be it the position sensor 34, the wire 38 or the converter 44, the whole sensor module 37 may be replaced with a new one without having to disassemble the actuator 10 from where it is mounted. This is a huge advantage as often, the actuator 10 is difficult to reach and there is not much space to work. Hence, having to replace only a relatively small sensor module 37 is a benefit. When such a replacement is required, a maintenance person may easily remove the screws 32 holding the cover 28 against the base 14, remove the sensor module 37 and disconnect the wire 38 by reaching inside the actuator with one hand. The wire 38, attached to the piston-rod assembly through an optional threaded attachment 52, may easily be unscrewed. Similarly, the installation of a new sensor module is as easily accomplished by doing the same steps in the reverse order. If ever the opening 26 is too small to accommodate the arm of a person, a special elongate tool may be used to reach inside and unscrew/screw the threaded attachment 52.

The present invention has been described with regard to preferred embodiments. The description as much as the drawings were intended to help the understanding of the invention, rather than to limit its scope. It will be apparent to one skilled in the art that various modifications may be made to the invention without departing from the scope of the invention as described herein, and such modifications are intended to be covered by the present description. The invention is defined by the claims that follow.

We claim:

1. A fluid-powered actuator comprising:

a cylindrical body having a base proximate one extremity and a head proximate another extremity, said base having an opening:

a piston-rod assembly slidably mounted inside said cylindrical body, the piston-rod assembly defining within the cylindrical body a first chamber contiguous to the base and a second chamber contiguous to the head, each chamber communicating independently with an external source of pressurized fluid used to control the position of the piston-rod assembly;

and a readily replaceable sensor module comprising a removable cover operative to sealably close said opening and a position sensor mounted to an internal face of said cover so that said position sensor is operatively located inside the first chamber of said cylindrical body when said cover is in place, said position sensor being operative to measure a position of said piston-rod assembly and being dimensioned to pass easily through said opening, such that said sensor module is selectively replaceable when said actuator is in service without having to disconnect the actuator from where it is mounted and while maintaining the application of pressurized fluid to the second chamber and thereby positioning and holding the piston-rod assembly in its fully retracted position, wherein said position sensor is a draw wire transducer using a wire, said wire being attached to said piston-rod assembly with a releasable connection.

2. The actuator of claim 1 wherein the wire is attached to the piston-rod assembly through a threaded connection.

3. The actuator of claim 1 further comprising an analog converter connected to said position sensor for converting a signal from said position sensor to an analog electric signal.

4. The actuator of claim 3 wherein said converter is mounted on said internal face of said cover.

5. The actuator of claim 4 further comprising an analog connector, said analog connector being located on an external face of said cover, said analog connector being connected to said position sensor.

6. The actuator of claim 5 further comprising digital discrete switches and a digital connector, said digital discrete switches being operatively located inside said cylindrical body to measure at least two positions of said piston-rod assembly, said digital connector being located on the external face of said cover, said digital connector being connected to the digital discrete switches of said position sensor.

7. A fluid-powered actuator comprising:

a cylindrical body defined by a side wall and two end walls that seal the extremities of the side wall, one of the end wall having a sealably-closable opening therein;

a piston and rod assembly slidably mounted inside the cylindrical body with the rod protruding through one of the end walls;

said piston defining with the end walls two chambers within the cylindrical body, each chamber communicating independently with an external control device for positioning the piston and rod assembly within the cylindrical body by applying pressurized fluid to each chamber;

and a readily replaceable sensor module comprising a removable cover operative to sealably close said opening in one of the end walls and a position sensor mounted to an internal face of said cover so that said position sensor is operatively located inside the cylindrical body when the cover is in place, the position sensor being operative to measure a position of the piston and rod assembly and being dimensioned to pass easily through the opening, such that the sensor module is selectively replaceable when the actuator is in service without having to disconnect the actuator from where it is mounted, and while maintaining the application of pressurized fluid to the chamber remote from the end wall having the opening therein, wherein each chamber communicates with the external source of pressurized fluid via a port extending through one of the end walls, wherein the rod of the piston and rod assembly protrudes through a first end wall and said opening is located in the second end wall, wherein said cover as adapted to fit at least partially within said opening, and wherein said position sensor is a draw wire transducer using a wire, said wire being attached to said piston-rod assembly with a releasable connection.

8. The actuator of claim 7 wherein the wire is attached to the piston-rod assembly through a threaded connection.

9. The actuator of claim 7 further comprising an analog converter connected to said position sensor for converting a signal from said position sensor to an analog electric signal.

10. The actuator of claim 9 wherein said converter is mounted on said internal face of said cover.

11. The actuator of claim 10 further comprising an analog connector, said analog connector being located on an external face of said cover, said analog connector being connected to said position sensor.

12. The actuator of claim 11 further comprising digital discrete switches and a digital connector, said digital discrete switches being operatively located inside said cylindrical body to measure at least two positions of said piston and rod assembly, said digital connector being located on the external face of said cover, said digital connector being connected to the digital discrete switches of said position sensor.

* * * * *